US010729219B2

(12) United States Patent
Lehner

(10) Patent No.: US 10,729,219 B2
(45) Date of Patent: Aug. 4, 2020

(54) TEMPLATE FOR FORMING A CONTOUR ON AN EYEBROW

(71) Applicant: Andrea Lehner, Gallneukirchen (AT)

(72) Inventor: Andrea Lehner, Gallneukirchen (AT)

(73) Assignee: andmetics GmbH, Traun (AT)

( * ) Notice: Subject to any disclaimer, the term of this patent is extended or adjusted under 35 U.S.C. 154(b) by 0 days.

(21) Appl. No.: 15/309,366

(22) PCT Filed: May 6, 2015

(86) PCT No.: PCT/AT2015/050112
§ 371 (c)(1),
(2) Date: Nov. 7, 2016

(87) PCT Pub. No.: WO2015/168717
PCT Pub. Date: Nov. 12, 2015

(65) Prior Publication Data

US 2017/0112259 A1 Apr. 27, 2017

(30) Foreign Application Priority Data

May 6, 2014 (AT) ..... 50321/2014

(51) Int. Cl.
*A45D 26/00* (2006.01)

(52) U.S. Cl.
CPC ..... *A45D 26/0014* (2013.01); *A45D 26/00* (2013.01); *A45D 26/0019* (2013.01); *A45D 2026/008* (2013.01)

(58) Field of Classification Search
CPC ..... A45D 26/0014; A45D 26/0019
See application file for complete search history.

(56) References Cited

U.S. PATENT DOCUMENTS 4,728,380 A * 3/1988 Jones ..... A61F 13/025 156/230
5,259,835 A * 11/1993 Clark ..... A61F 13/0246 602/48
6,336,462 B1 1/2002 Santelli et al.
7,322,991 B1 1/2008 Robinson
2004/0226572 A1* 11/2004 Baker ..... A45D 26/0019 132/216
2005/0070963 A1* 3/2005 Wilson ..... A45D 26/0019 607/5
2005/0182443 A1* 8/2005 Jonn ..... A61L 24/06 606/213
2006/0002878 A1* 1/2006 Acher ..... A45D 26/0019 424/70.11
2012/0197268 A1 8/2012 Tran
(Continued)

FOREIGN PATENT DOCUMENTS

CH 706809 2/2014

*Primary Examiner* — Alexander J Orkin

(57) ABSTRACT

A template for forming a contour on an eyebrow, having a hair-removing means, having a flat, flexible support, which has a support edge that follows the lower contour curve to be formed for the eyebrow and a hair-removing region adjoining this support edge, which is coated with a hair-removing means, and having an optical positioning aid provided on at least one lateral half of the template for positioning the template relative to the eyebrow. For a simple use of the template with reproducible results, it has a positioning aid on each of the two halves.

14 Claims, 2 Drawing Sheets

(56) References Cited

U.S. PATENT DOCUMENTS

| | | | | |
|---|---|---|---|---|
| 2013/0204274 | A1* | 8/2013 | Campbell | A45D 26/0014<br>606/133 |
| 2013/0263885 | A1 | 10/2013 | Sternad | |
| 2013/0282049 | A1* | 10/2013 | Peterson | A61B 17/085<br>606/204.45 |
| 2014/0350575 | A1* | 11/2014 | DiSotto | A45D 26/0014<br>606/134 |

* cited by examiner

TEMPLATE FOR FORMING A CONTOUR ON AN EYEBROW

FIELD OF THE INVENTION

The invention relates to a template for forming a contour on an eyebrow, having a hair-removing means, preferably hair-removing wax, having a flat, flexible support, which has a support edge that follows the lower contour curve to be formed for the eyebrow and a hair-removing region adjoining this support edge, which is coated with a hair-removing means, and having an optical positioning aid provided on at least one lateral half of the template for positioning the template relative to the eyebrow.

BACKGROUND OF THE INVENTION

In the prior art, U.S. Pat. No. 6,336,462 B1 discloses a template for tracing the eyebrow contour. To this end, this template surrounds the eyebrows completely—but can also have a hair-removing means for epilating eyebrows outside of a predetermined template contour. It has turned out to be disadvantageous that the positioning of the template is complex and laborious so that most often, professionally trained personnel are required to accomplish it.

In addition, CH706809 has disclosed a template for waxing a contour of an eyebrow. This template, which is coated with hair-removing wax, has a positioning aid in the form of a point in the region of the nose side.

There are also known templates ("Balea"—eyebrow epilation strips), which are placed on the underside of the eyebrow in order to establish the lower contour curve to be formed for the eyebrow by means of epilation. These templates have a transparent support, which is partially coated with a slightly sticky adhesive as a hair-removing means and constitutes a hair-removing region. For positioning, the template has an optical positioning aid—for this purpose, a recess for accommodating the end of the eyebrow is provided in the inner lateral half of the support, which ends in the region of the middle of the face. With a positioning aid of this kind, an exact positioning or alignment of the templates is not possible or can only be achieved with difficulty due to different eyebrow shapes and sizes. With templates of this kind, which are awkward to maneuver, a reproducible result is not possible or can only be achieved with great difficulty. In addition, it is often also necessary for the user herself to shape and immobilize the end region of the eyebrow, which is used for positioning this template—as a result of which the positioning aid can in turn be used only to a limited degree for an exact positioning or alignment of the template.

SUMMARY OF THE INVENTION

The object of the invention, therefore, is to create, based on the above-explained prior art, a template for forming a contour on an eyebrow contour, which can be used in a versatile, simple way that yields a reproducible result. In addition, the template should be inexpensive to produce.

The invention attains the stated object in that the template has a positioning aid on each of the two halves, particularly in the form of at least one marking.

If the template has a positioning aid on each of the two halves, then the template can be aligned with relative ease and can thus be brought into and fastened in a secure position along the lower half of the eyebrow. Positioning aids, for example in the form of markings, can be used to establish a certain predetermined or desired distance from the nearest corner of the eye, for example. It is thus possible to position a template in a reproducible, i.e. easy-to-repeat, fashion in certain locations. Since the template is simultaneously provided with a hair-removing means, by subsequently pulling it off, the lower contour curve of the eyebrow can be brought into the desired form. It is thus possible for the lower contour curve of the eyebrow—which is to be formed—to begin and end at a desired location. In this case, for example, it is also possible to take into account the dependence of the size of the eye—e.g. in that the positioning aid has more than one marking. According to the invention, the horizontal alignment of a template can be facilitated if template has a positioning aid (8) on each of the two halves (9, 10). This can occur, for example, by allocating the positioning aids to respective established reference points on the face. The advantages can also result in the fact that the contours on both eyebrows formed by means of templates according to the invention are also aligned with each other correctly, symmetrically, and in the desired fashion. The template for producing a desired eyebrow contour can thus be used in a versatile way, is easy to maneuver, and yields reproducible results. In addition, the positioning aids can be provided on both halves in a simple way, thus making it possible to reduce the production costs of the template.

In general, it has been determined that a positioning aid can be embodied both as a colored marking in the form of points or lines and as recesses, raised areas, colored points, colored lines, or the like in the template. It is thus possible to give the user an optical sensation that makes the positioning aid optically perceptible. In this case, the positioning aids can also constitute a marking whose straightforward connection with the respective eye corner associated with the respective half aims at the angle of the nose. Alternatively, it is also conceivable for a marking to be provided on each lateral half, which with the desired positioning of the template, has the same distance from the closest corner of the eye. It is also conceivable for there to be a positioning aid in the form of a marking for each half, which when the template is correctly positioned, is situated in the center between the eyebrow end and the respective corner of the eye. In addition, it is generally noted that the support can, for example, be a fleece. In general, it should be noted that the template preferably only has the kind of support edge that forms the lower contour curve for the eyebrow.

The positioning aids, which are embodied in the form of at least one marking, can be particularly easy to maneuver.

The maneuvering of the template can be further facilitated if the flat support has at least one holding region adjacent to the hair-removing region. In such a holding region, the template can be easily and securely grasped—whether this is done in order to position it relative to the eyebrow or to pull it off for epilation purposes. For example, a holding region in the vicinity of the outer corner of the eye can make it possible to pull out the hair in the direction opposite from its direction of growth. This ensures the ability to use the template according to the invention in a versatile way.

If the one holding region is embodied as a tab and in particular, is free of hair-removing means, then this can further facilitate removal of the template and in particular, tabs of this kind permit a better grip on the template.

Preferably, the holding region is free of hair-removing means in order to thus make the template even easier to maneuver.

If the flat support has two holding regions on opposite sides from each other adjacent to the hair-removing region, then depending on the use of one of the holding regions, the template can be pulled off with or against the direction of growth of the hair.

If the support is coated with an opaque hair-removing means, then the template can be positioned in a particularly easy, precise, and advantageous way—this is particularly true if the support is transparent. In this case, the hair-removing means, which directly adjoins the support edge that forms the eyebrow contour, improves the visibility of the support edge. It is thus possible by means of the opaque hair-removing means to emphasize the eyebrow contour that is to be subsequently produced—this can contribute among other things to the facilitated positioning.

If one half has one marking for positioning the template in the eyebrow region that ends in the nose region, then this marking can be used for a first, preliminary positioning of the template on the eyebrow in the nose region. If in addition, the other half has two markings for positioning the template in the eyebrow region that ends in the vicinity of the temple, then these markings can be used for the final placement and positioning of the template starting from then nose region through the corner of the eye, and along the eyebrow contour. In addition, two markings in the region of the temple end of the eyebrow permit the use of the template for eyebrows of different lengths. Furthermore, the combination of one marking in the vicinity of the inner end of the eyebrow and two markings in the vicinity of the outer end of the eyebrow largely prevents confusion between the templates for the left and right eyes. It is thus possible to further improve an easy-to-use template for forming the lower eyebrow contour.

If the marking is point-shaped, then the template can be used for different face shapes. By contrast with a linear marking, which would have to be adapted relatively precisely to the respective face shape or eye shape, a point-shaped marking can be used in a significantly more versatile, independent way for the positioning of the template.

If the positioning aids are located in the hair-removing region of the support, then they or possibly their markings can lie correspondingly close to the eyebrow, making it possible to achieve a particularly precise positioning.

A template that is simple to manufacture from a production standpoint can be achieved if the positioning aids are provided on the support side opposite from the side of the support that is coated with the hair-removing means.

Preferably, the hair-removing means is a hair-removing wax.

If the hair-removing means contains resin (rosin), then the eyebrow hairs to be removed can be glued to the support and pulled out in the direction opposite from the direction of hair growth. Specifically with resin-based or rosin-based hair-removing means, it is possible to achieve powerful adhesion forces to the hair to be removed, which can permit an effective epilation of the eyebrow contour.

Alternatively, the hair-removing means can contain sugar.

If the support edge has a first ascending contour section and a second descending contour section, then it is possible to achieve an eyebrow contour that is particularly visually attractive. This can be improved even more if these contour sections adjoin each other by means of a corner-shaped transition.

The eyebrow contour can be improved further if the curve formed on the eyebrow by the first contour section is twice as long as the one formed by the second contour section.

If the curve formed on the eyebrow by the first contour section is twice as long as the one formed by the second contour section, then the contour can be even further improved in terms of its visual appeal.

The maneuvering of the template can be further improved if the positioning aid has haptic elements. These haptic elements can be achieved by means of raise areas or stamped areas or by modifying the support surface, e.g. by roughening.

If the support has at least two recesses for grasping the template with the fingertips, then this can make the template even easier to maneuver—specifically, it is thus possible to offer the option of grasping and positioning the template with one hand.

BRIEF DESCRIPTION OF THE DRAWINGS

The subject of the invention is illustrated in greater detail by way of example in the drawings based on several exemplary embodiments. In the drawings.

DETAILED DESCRIPTION OF THE PREFERRED EMBODIMENTS

Figure 1:
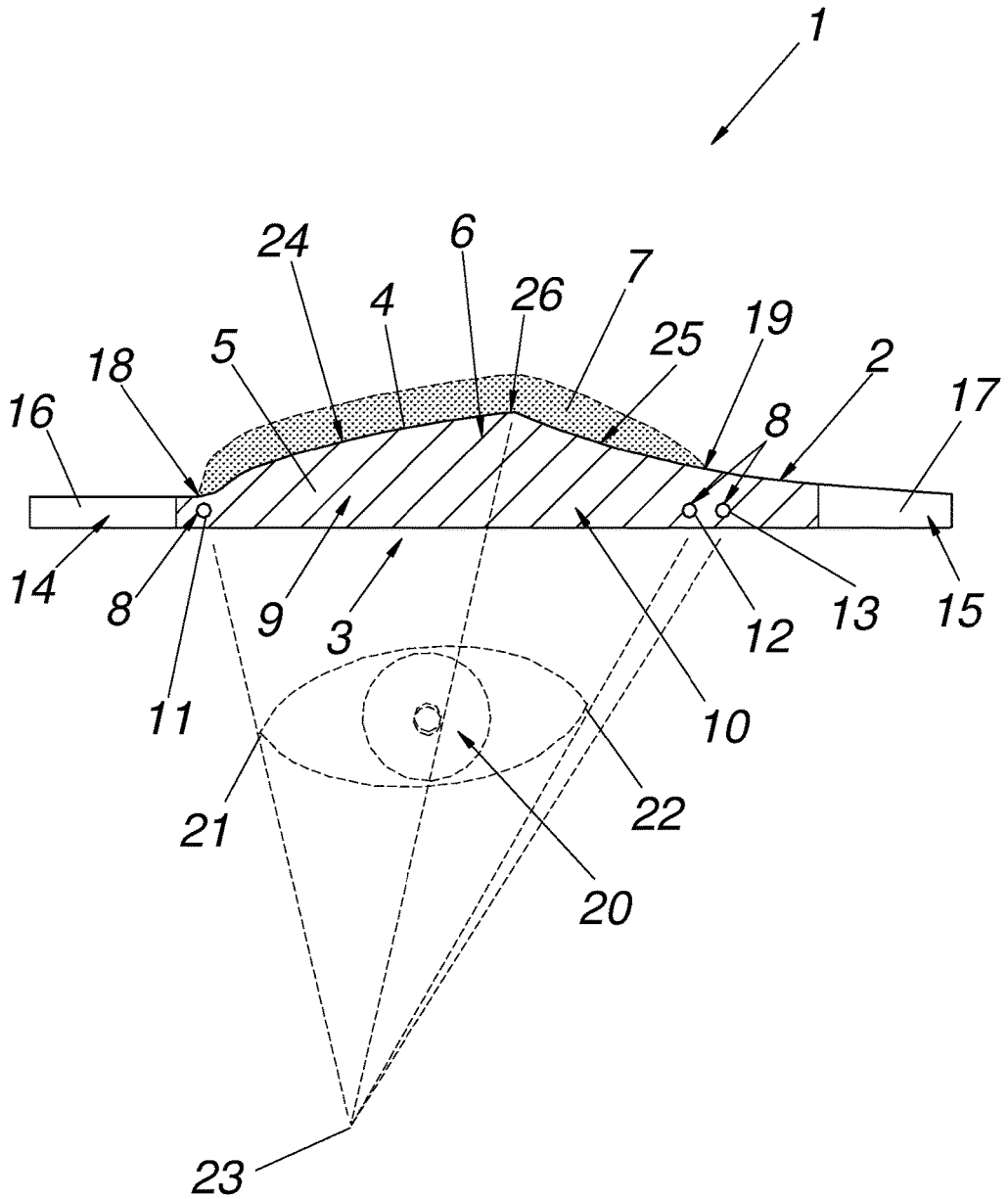
FIG. 1 shows a front view of a template according to a first exemplary embodiment.

FIG. 1 shows a front view of the template 1 according to a first exemplary embodiment for forming a lower eyebrow contour 2. The template 1 is composed of a flat, flexible support 3 whose support edge 4 forms the eyebrow contour 2. For this purpose, the hair-removing region 5 adjacent to the support edge 4 is coated with a hair-removing means 6, preferably hair-removing wax. Forming the contour curve 2 for the eyebrow 7 clearly requires a precise positioning of the support edge 4 relative to the eyebrow 7.

This is achieved with optical positioning aids 8 on the two opposing lateral halves 9, 10. In this case, the positioning aids 8 are provided in the form of optically perceptible markings 11, 12, 13 on the template 1. It is thus relatively easy to align and place it in a secure position along the lower half of the eyebrow 7. The hair-removing means 6 adheres to the hair in the hair-removing region 5 of the template 1 and by the subsequent pulling off of the template 1, permits the lower eyebrow contour 2 to be brought into the desire form. The new eyebrow contour 2 is thus produced in a reproducible, reliable, and simple way. In addition, the markings 11, 12, 13, which can be produced for example by means of punching, can be easily provided during the production of the template 1, which reduces the manufacturing costs of the template 1.

Adjacent to the hair-removing region 5, the flat support 3 has two holding regions 14, 15. These make it easy to grasp the template 1 and facilitate the maneuvering thereof. In this connection, it is conceivable for only one of these two holding regions 14, 15 to be provided, which has not been shown in detail in the templates according to FIG. 1 and FIG. 2.

Figure 2:
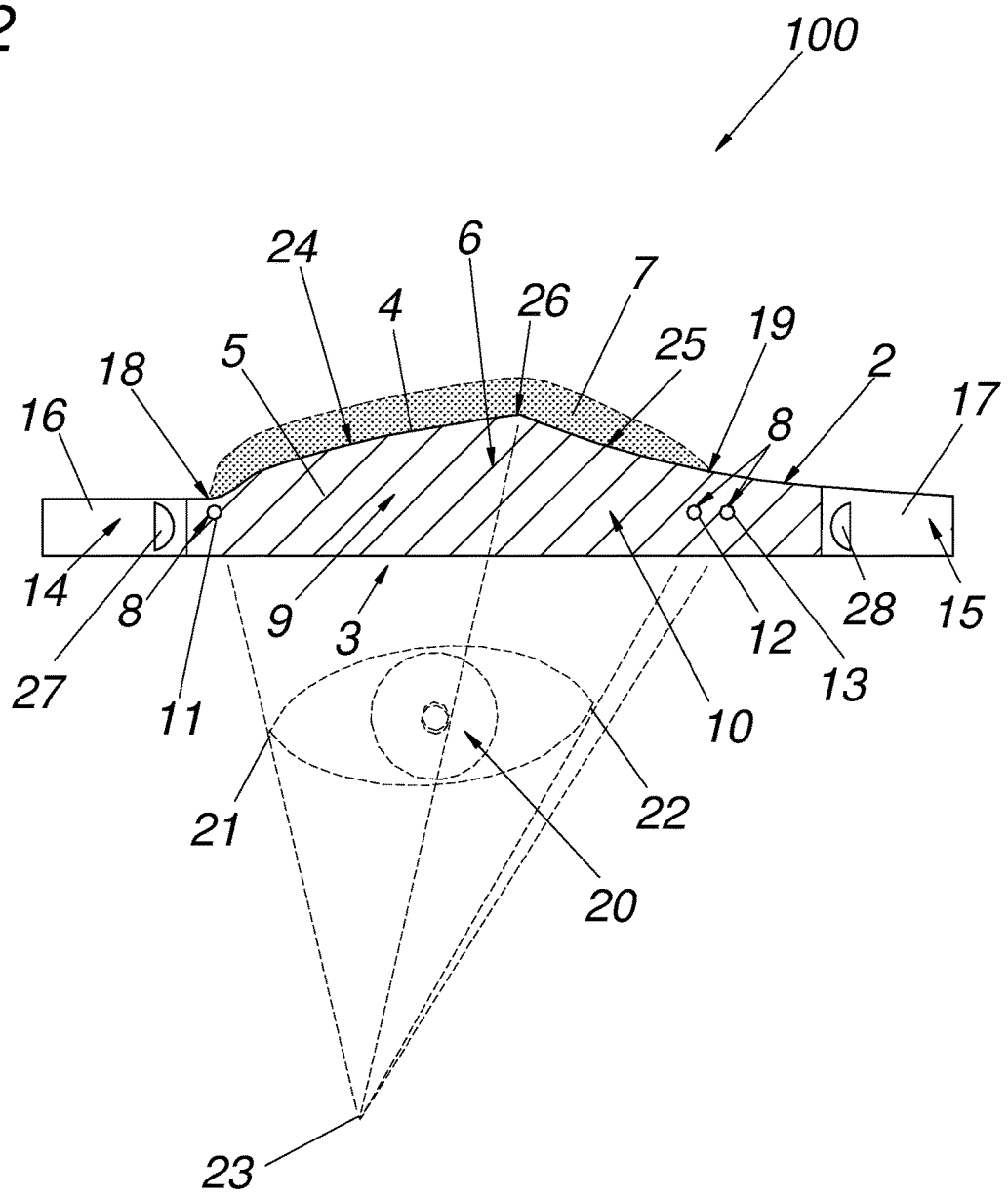
FIG. 2 shows front view of a template according to another exemplary embodiment.

In the exemplary embodiments according to FIG. 1 and FIG. 2, the holding regions 14, 15 are embodied as tabs 16, 17 and are free of hair-removing means 6. These tabs 16, 17 make it easier to pull off the template 1, thus facilitating the accompanying hair removal procedure. Specifically, the tabs 16, 17 can be securely grasped between the thumb and forefinger. Depending on whether the inner tab 16 or outer tab 17 is used for the pulling-off, the template 1 can be pulled off with or against the growth direction of the hair.

The support 3 is transparent and is coated with an opaque hair-removing means 6. This makes the support edge 4 easier to see, which is advantageous for a precise positioning. The opaque hair-removing means 6 nevertheless allows the rest of the eyebrow 7 to still be seen while the template 1 is being positioned.

The half 9 closer to the nose has a positioning aid in the form of a marking 11 for positioning the template 1 at the eyebrow end 18 that ends in the vicinity of the nose. This marking 11 is used for an initial placement and positioning of the template 1 in the nose region of the eyebrow 7. The half 10 closer to the temple has two markings 12, 13 for easier positioning of the template 1 at the eyebrow end 19 that ends in the vicinity of the temple. These markings 12, 13 are used for the final placement and positioning of the template 1, which is already affixed in the nose region. In this case, the second marking 13 also permits the template 1 to be used with larger eyes 20. In addition, the provision of one inner marking 11 and two outer markings 12, 13 largely prevents a confusion of the templates 1, 100 provided for the left or right eye 20.

The markings 11, 12, 13 shown in the exemplary embodiments are point-shaped and can, for example, be punched-out openings in the support 3. These points are aligned by means of a linear connection from the eyebrow ends 18, 19 to the respective eye corners 21, 22. If the extensions of the lines point at the lower corner of the nose 23, then the template 1 is positioned correctly, i.e. in the desired way. This also facilitates the horizontal alignment of the template and also insures that the contours on both eyebrows are optimally aligned with each other. Consequently, the template 1 can be used in a versatile way for producing a desired eyebrow contour, is easy to maneuver, and can yield reproducible results. In this connection, by contrast with a linear marking, which would have to be adapted in a relatively precise way to the respective face shape and eye shape, the point-shaped marking contour permits the template 1 to be used in a versatile and universal way.

According to FIGS. 1 and 2, the positioning aids 8 are situated in the hair-removing region 5. Since the positioning aids 8 are provided on the support side opposite from the side of the support 3 that is coated with hair-removing means 6, there is no danger of covering the positioning aid 8 with the hair-removing means 6.

In this exemplary embodiment, resin-based or rosin-based hair-removing wax is used as the hair-removing means 6. Consequently, the holding forces required for removing the hair during the pulling-off procedure are insured between the template 1 and the hair. It is naturally conceivable, however, to use sugar-based means or other conventional hair-removing means 6.

The contour curve 2 of the eyebrow 7 is formed by the support edge 4, which has a first ascending contour section 24 extending outward from the middle of the face and adjoining this, a second descending contour section 25. In this connection, the first ascending contour section 24 of the eyebrow 7 is twice as long as the second descending contour section 25 of the eyebrow, which turns out to be advantageous with regard to the visual effect of the eyebrow contour that is achieved in this way. This is further improved since these contour sections 24, 25 adjoin each other by means of a corner-shaped transition 26, which comes to rest in the extension of a line leading from the corner of the nose 23 through the outer edge of the pupil 20.

The fine positioning of the template 1, even with positioning aids 8 that are covered by fingers or the hand, is enabled and improved by means of a template 1 whose positioning aid 8 has haptic elements. In the case shown, these haptics are achieved by punching out the markings 11, 12, 13.

Corresponding to FIG. 2, an embodiment variant of the additional template 100 is shown in which by contrast with the template 1 according to FIG. 1, the support 3 has two recesses 27, 28 for grasping the template 1 with the fingertips. This permits the template 100 to be grasped and positioned with one hand and facilitates maneuvering of the template 100.

The invention claimed is:

1. A template for forming a contour on an eyebrow, comprising:

a hair-remover;

a flat, flexible support, which has a support edge that follows only a lower contour curve to be formed for the eyebrow when the entire support is positioned below the eyebrow, wherein the support edge has a first ascending contour section and a second descending contour section and these contour sections adjoin each other in a corner-shaped transition, and the flat, flexible support having no support edge along an upper contour curve of the eyebrow, and having a hair-removing region adjoining the support edge, which is coated with the hair-remover, and the flat, flexible support also has at least two holding regions each adjacent to and on opposite sides of the hair-removing region, wherein the holding regions are free of the hair-remover; and an optical positioning aid provided on each lateral half of the template for positioning the template relative to the eyebrow, with one half of the template having at least one positioning aid for positioning the template in a user's eyebrow region that ends in a vicinity of the user's nose and the other half having at least one positioning aid for positioning the template in an eyebrow region that ends in a vicinity of the user's temple.

2. The template according to claim 1, wherein the positioning aids are embodied in the form of at least one marking.

3. The template according to claim 2, wherein the marking is point-shaped.

4. The to template according to claim 1, wherein the holding regions are each embodied as a tab.

5. The template according to claim 1, wherein the support is coated with an opaque hair-remover.

6. The template according to claim 1, wherein one half of the template has one marking for positioning the template in the user's eyebrow region that ends in the vicinity of the user's nose and the other half has two markings for positioning the template in the eyebrow region that ends in the vicinity of the user's temple.

7. The template according to claim 1, wherein the positioning aids are located in the hair-removing region of the support.

8. The template according to claim 1, wherein the positioning aids axe provided on the support side opposite from the side of the support that is coated with the hair-remover.

9. The template according to claim 1, wherein the hair-remover is a hair-removal wax.

10. The template according to claim 1, wherein the hair remover contains resin (rosin).

11. The template according to claim 1, wherein the hair-remover contains sugar.

12. The template according to claim 1, wherein the curve formed on the eyebrow by the first contour section is twice as long as the curve formed by the second contour section.

13. The template according to claim 1, wherein the positioning aid has haptic elements.

14. The template according to claim 1, wherein the support has two recesses for grasping the template with a user's fingertips.

* * * * *